US006237825B1

(12) United States Patent
Pencoske

(10) Patent No.: US 6,237,825 B1
(45) Date of Patent: May 29, 2001

(54) SEE-THROUGH BOOKBAG

(76) Inventor: Edward Leroy Pencoske, 108 B Colbaugh Dr., Trafford, PA (US) 15085

( * ) Notice: Subject to any disclaimer, the term of this patent is extended or adjusted under 35 U.S.C. 154(b) by 0 days.

(21) Appl. No.: 09/309,661

(22) Filed: May 8, 1999

(51) Int. Cl.[7] ..... A45F 3/04

(52) U.S. Cl. ..... 224/645; 224/627; 224/653; 383/117

(58) Field of Search ..... 224/627, 645, 224/681, 653; 383/117

(56) References Cited

U.S. PATENT DOCUMENTS 3,483,907 * 12/1969 Corridon ..... 383/117
4,883,207 * 11/1989 McArthur ..... 224/153
5,255,833 * 10/1993 McAllister ..... 224/257
5,366,126 * 11/1994 Dausien ..... 224/630
5,573,154 * 11/1996 Tietze ..... 224/153
5,573,166 * 11/1996 Leja ..... 224/630
5,676,296 * 10/1997 Masters ..... 224/653
5,706,992 * 1/1998 Moor ..... 224/657
5,819,998 * 10/1998 Chehebar ..... 224/153
5,957,354 * 9/1999 Mentken ..... 224/627
5,979,722 * 11/1999 Gonzales ..... 224/153
5,984,154 * 11/1999 Scicluna ..... 224/653

FOREIGN PATENT DOCUMENTS

942764 * 5/1956 (DE) ..... 383/117

* cited by examiner

*Primary Examiner*—Stephen P. Garbe
(74) *Attorney, Agent, or Firm*—Edward L. Pencoske

(57) ABSTRACT

The present invention is directed to a see-through bookbag and, according to one embodiment, a see-through book bag containing an envelop for carrying artwork or advertising material.

7 Claims, 2 Drawing Sheets

SEE-THROUGH BOOKBAG

BACKGROUND OF THE INVENTION

1. Field of the Invention

The present invention is directed to bookbags and backpacks.

2. Description of the Background

Backpacks and bookbags have become the preferred mode of school children of all ages for transporting all manner of school books, school supplies, papers, projects, etc. The backpack or bookbag can be worn on the students back leaving the hands free. Backpacks and bookbags often have various pockets or compartments for carrying smaller items such as pencils, rulers, crayons, etc. The backpack or bookbag, by its very nature, provides a convenient means for transporting materials.

Recent events in which children have brought weapons or bombs into schools have caused many school systems to implement programs in which bookbags and backpacks must be passed through metal detectors or inspected prior to the student being allowed to bring them into school. School systems not haveing the money or manpower to implement such programs have banned backpacks and bookbags altogether. Thus, the need exists for a bookbag or backpack which provides all the traditional convenience of a backpack but does not raise any safety concerns.

SUMMARY OF THE INVENTION

The present invention is directed to a see-through bookbag or backpack. The backpack is comprised of a see-through backplate to which straps are attached. The backplate may be solid, or pliable, but should be of sufficient strength to enable the straps to be attached thereto in a manner to support the weight carried by the backpack. The remainder of the backpack may be constructed in the usual manner, but is constructed of see-through materials. According to another embodiment of the present invention, the remainder of the backpack is consturcted of see-through netting.

BRIEF DESCRIPTION OF THE DRAWINGS

For the present invention to be easily understood and readily practiced, the present invention will now be described, for purposed of illustration and not limitation, in conjunction with the following figures wherein.

DESCRIPTION OF THE PREFERRED EMBODIMENTS

Figure 1:
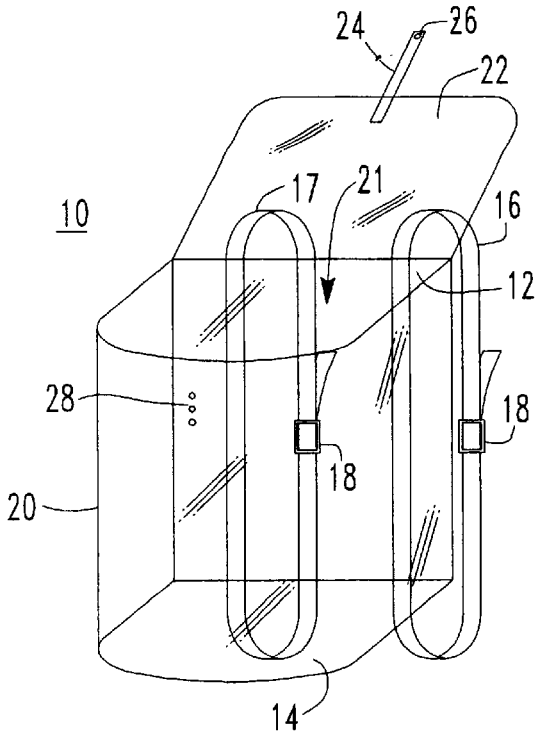
FIG. 1 illustrates a preferred embodiment of the present invention.

FIG. 1 illustrates a preferred embodiment of the present invention which is a bookbag 10 constructed of see-through materials. In its simplest form, the bookbag 10 may be constructed as a typical prior art cloth or plastic bookbag, but according to the present invention, would be made entirely of see-through materials except, optionally, the straps.

In FIG. 1, the bookbag 10 is comprised of a backplate 12 which may be rigid or pliable. Base plate 14 is connected to the backplate 12 at the lower end of the backplate 12. The baseplate 14, like the backplate 12, may be rigid or pliable. The baseplate 14 could alternatively be an extension of the backplate 12 with a fold or bend occuring where the connection would be if the baseplate 14 were a separate part. A pair of straps 16, 17 are connected to the backplate 12 in any conventional manner to enable the load carried by the backpack 10 to be born by the straps 16, 17. The straps 16, 17 may each contain a buckle 18 to enable the length of the straps to be adjusted to accomodate the user.

A clear wall member 20 provides the other three side walls, such that the wall member 20 together with the backplate 12 provide a chamber 21 for carrying books and other materials. The wall member 20 is connected to the baseplate 14 to enclose the bottom of the chamber 21. Alternatively, wall member 20 could be comprised of three separate pieces.

A lid or flap 22 is also provided. The lid 22 is connected to the backplate 12 and, on the edge opposite of the edge connected to the backplate 12, carries a small strap 24 with the male portion of a snap 26 which mates with one of the female portions of the snap 28 carried on the front of the bookbag 10. With the backplate 12, baseplate 14, wall member 20, and flap 22 all constructed of see-through materials, security concerns are eliminated.

Figure 2:
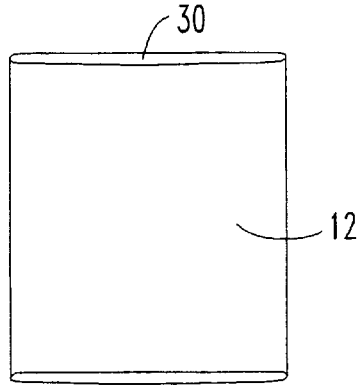
FIG. 2 illustrates an alternative embodiment of the backplate of the present invention.

Bookbags have bcome a source of revenue for tie-ins with movies and toys. A picture of the latest monster or a favority toy is very often the motivation for the sale of a bookbag rather than issues of size or construction. If desirable, the backplate 12 could cary the advertising as such advertising would not obstruct a view of the contents of the bookbag when it is worn. The backplate 12 could have a double walled construction as shown in FIG. 2 so as to create an envelop 30 which could contain various artwork such as pictures, photographs, holograms, or any substantially flat material. A manufacturer could provide a bookbag that could be equipped with an advertisement that can be slipped into the pocket or, for strict school districts or school districts with varying standards, the advertisement removed to provide a completlely see-through bookbag. In that manner, manufacturers could manufacture and distribute one product nationwide. Parents could still buy their children a bookbag with a picture of a favorite movie content in the knowledge that if the school district changes its policy, the picture can be removed.

Figure 3:
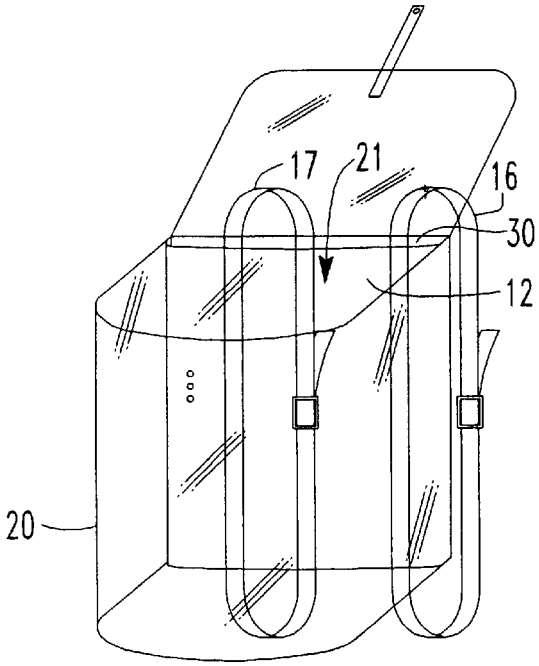
FIGS. 3–7 illustrate other embodiments of the present invention.

Many modifications and variations of the present invention are possible. FIG. 3 illustrates an embodiment of the invention wherein the backplate 12 is eliminated and the wall member 20 is designed to form the chamber 21 by itself. In this embodiment the straps 16, 17 are connected to the wall member 20. The portion of the wall member 20 to which the straps are attached may carry the envelop 30.

Figure 4:
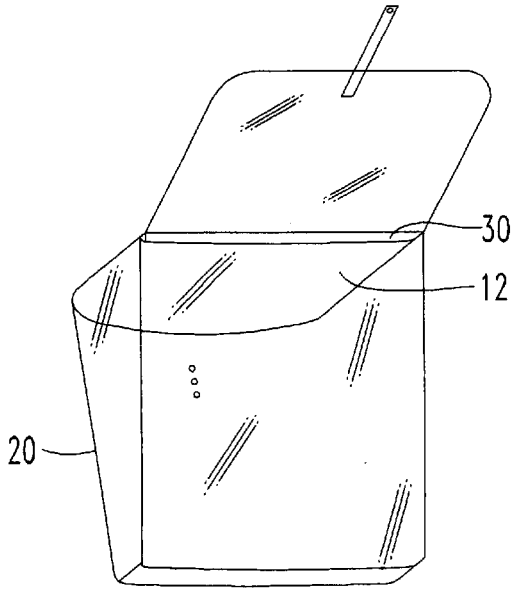

FIG. 4 illustrates an embodiment wherein the baseplate 14 is eliminated. The straps have not been shown for purposes of clarity.

Figure 5:
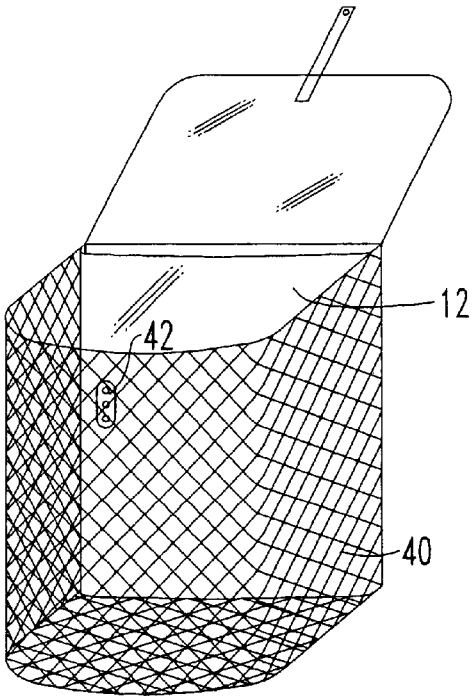

FIG. 5 illustrates an embodiment similar to FIG. 1 but with the wall member 20 constructed of netting 40. Again, the straps 16, 17 have not been shown for purposes of clarity. A small piece of plastic 32 may be provided for carrying the female portions 28 of the snap or other types of closure devices may be provided.

Figure 6:
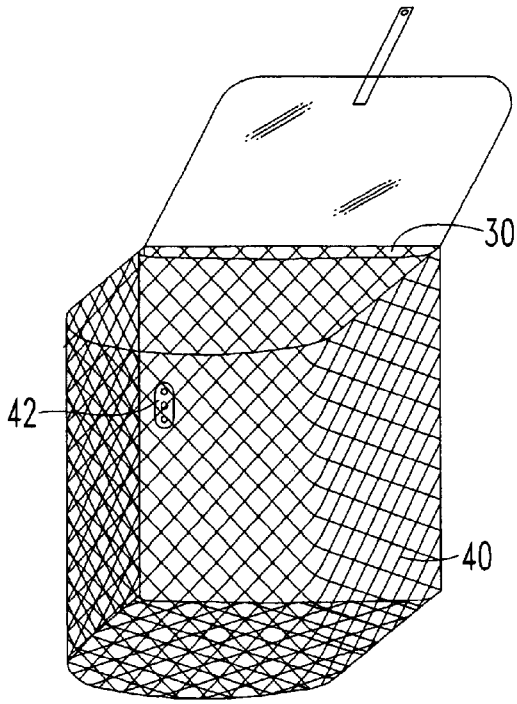

FIG. 6 illustrates an embodiment similar to FIG. 3, i.e. no backplate 12, but with the wall member 20 constructed out of netting 40. The netting material can be constructed to form the envelop 30. The straps 16, 17 have not been shown for clarity.

Figure 7:
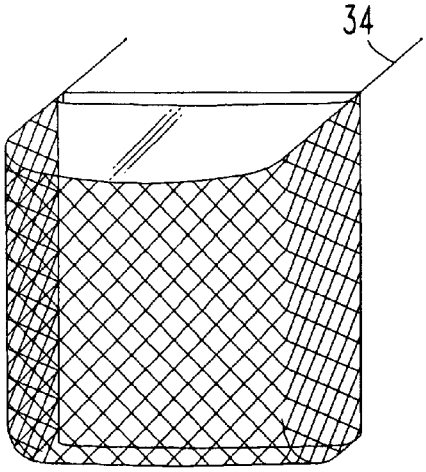

FIG. 7 illustrates an embodiment similar to FIG. 4 but with the wall member constructed out of netting 40. The netting material can be constructed to form the envelop 30. The straps have not been shown for clarity. A draw string 34 is used to close the bookbag 10.

While the present invention has been shown in conjunction with a plurality of preferred embodiments, those of ordinary skill in the art will undoubtedly devise many variations and alterations of the disclosed embodiments. In such a simple device, it is impossible to specifically identify all the posible variations because, for example, a single part can be made as two parts, two parts can be combined into one, various types of closure devices can be used in place of flap 22 and snaps 26, 28, a single strap may be used in place of the pair of straps, the pair of straps may be attached in a variety of configurations, the backpack may be construced of material having a faint color thereto (but not sufficient to inhibit viewing of the contents), etc. Having disclosed a sufficient number of embodiments to adequately explain the invention, the following claims are intended to cover not only the disclosed embodiments, but also variations thereof.

What is claimed is:

1. A backpack, comprising:

a backplate having first and second walls defining an envelope, at least one of said walls being see-through;

at least one strap connected to said backplate;

a baseplate connected to said backplate; and a clear wall member connected to said backplate and said baseplate to define a chamber.

2. The backpack of claim 1 wherein said at least one of said walls being see-through includes a wall that is transparent.

3. The backpack of claim 1 wherein said at least one of said walls being see-through includes a wall constructed of a mesh material.

4. The backpack of claim 1 additionally comprising a lid hingedly connected to said backplate.

5. A backpack, comprising:

a backplate having first and second walls defining an envelope, at least one of said walls being see-through;

at least one strap connected to said backplate;

a see through member connected to said backplate so as to define a chamber, and a lid hingedly connected to said backplate.

6. The backpack of claim 5 wherein said see-through wall and member are transparent.

7. The backpack of claim 5 wherein said see-through wall and member are a mesh material.

* * * * *